US008590250B2

(12) United States Patent
Oh

(10) Patent No.: US 8,590,250 B2
(45) Date of Patent: Nov. 26, 2013

(54) FLOORING MATERIAL AND A ROTATIONAL BODY USED THEREWITH

(76) Inventor: Kwang Seok Oh, Busan (KR)

( * ) Notice: Subject to any disclaimer, the term of this patent is extended or adjusted under 35 U.S.C. 154(b) by 0 days.

(21) Appl. No.: 13/582,448

(22) PCT Filed: Feb. 14, 2011

(86) PCT No.: PCT/KR2011/000964
§ 371 (c)(1),
(2), (4) Date: Sep. 3, 2012

(87) PCT Pub. No.: WO2011/108812
PCT Pub. Date: Sep. 9, 2011

(65) Prior Publication Data

US 2012/0317916 A1 Dec. 20, 2012

(30) Foreign Application Priority Data

Mar. 2, 2010 (KR) ..... 10-2010-0018434

(51) Int. Cl.
*E04F 15/02* (2006.01)

(52) U.S. Cl.
USPC ..... 52/586.2

(58) Field of Classification Search
USPC ..... 52/582.1, 582.2, 586.2, 586.1
See application file for complete search history.

(56) References Cited

U.S. PATENT DOCUMENTS

| | | | | |
|---|---|---|---|---|
| 7,726,088 | B2 * | 6/2010 | Muehlebach | 52/582.1 |
| 7,980,039 | B2 * | 7/2011 | Groeke et al. | 52/582.2 |
| 8,220,217 | B2 * | 7/2012 | Muehlebach | 52/582.1 |
| 8,302,367 | B2 * | 11/2012 | Schulte | 52/747.11 |
| 2008/0134613 | A1 * | 6/2008 | Pervan | 52/582.2 |
| 2011/0167751 | A1 * | 7/2011 | Engstrom | 52/588.1 |
| 2011/0271632 | A1 * | 11/2011 | Cappelle et al. | 52/582.2 |
| 2012/0073235 | A1 * | 3/2012 | Hannig | 52/588.1 |

FOREIGN PATENT DOCUMENTS

| | | |
|---|---|---|
| KR | 20-0428422 | 10/2006 |
| KR | 10-0753474 | 8/2007 |
| KR | 10-0918281 | 9/2009 |

OTHER PUBLICATIONS

International Search Report for PCT/KR2011/000964 Mailed on Oct. 26, 2011.

* cited by examiner

*Primary Examiner* — Christine T Cajilig
(74) *Attorney, Agent, or Firm* — Christopher Paul Mitchell

(57) ABSTRACT

Provided are a flooring material and a rotational body used therewith which are adapted to improve quality reliability in flooring materials by stably providing not only a fastening force in the horizontal direction but also a fastening force in the vertical direction when flooring panels are assembled with each other, thereby facilitating assembly of the flooring panels and strengthening the joining force due to assembly.

15 Claims, 8 Drawing Sheets

FLOORING MATERIAL AND A ROTATIONAL BODY USED THEREWITH

RELATED APPLICATIONS

This application is a 371 application of International Application No. PCT/KR2011/000964, filed Feb. 14, 2011, which in turn claims priority from Korean Patent Application No. 10-2010-0018434, filed Mar. 2, 2010, each of which is incorporated herein by reference in its entirety.

FIELD OF THE INVENTION

The present invention relates to a flooring material, more specifically, assembly-type flooring material installed on the floor of building etc.

DESCRIPTION OF RELATED ART

In general, the flooring material is intended to decorate the floor of building, and conventionally the flooring material made of synthetic resin is used, however in recent, use of the flooring material made from wood is increased according to demand of the high classification and functionalization of flooring material.

Such flooring material made from wood is achieved by assembling a plurality of flooring panels with one another, and the flooring panel consists of wood, plywood, MDF, HDF, PB, PVC and any mixture or compound thereof.

A construction is known where for enhancing workability by facilitating assembly of the flooring panels with one another, fastening structure is provided on side surfaces of long and short sides of the flooring panel, thus both side surfaces are fastened and assembled in assembly manner.

As one of such fastening construction, a fastening structure utilizing folding-down manner is known.

Such a fastening manner provides stable fastening force of horizontal direction, but since there are no elements for preventing deviation in vertical direction, the fastening of folding-down manner as described above has a problem that while fastening of horizontal direction is stable, the flooring panel cannot be prevented from easily deviating in vertical direction.

By the way, when the flooring material is formed by the fastening of folding-down manner, if a third flooring panel is assembled to the long sides of the two flooring panels after the shorts sides of two flooring panels are fastened so as to abut against each other, the fastening force of vertical direction is produced which can prevent vertical deviation of the flooring panels to some extent, but also in such a case, a problem is present that central portions of the abutted short sides of the two flooring panels are separated from each other and raised while being displaced from each other, which acts as a factor of deteriorating the quality of flooring material.

SUMMARY OF THE PRESENT INVENTION

An object of the present invention is to provide a flooring material and a rotational body used therewith which are adapted to improve reliability in quality of flooring materials by stably providing not only the fastening force of horizontal direction but also the fastening force of vertical direction when flooring panels are assembled with each other, thereby facilitating assembly of the flooring panels and strengthening the joining force due to assembly.

Furthermore, another object of the present invention is to provide a flooring material and a rotational body used therewith which facilitate separating of the flooring panels in the opposite direction when problems have arisen in the flooring panels after assembling thereof, thereby saving time, labor and cost required for executing of the flooring panels and increase the convenience of execution.

According to an aspect of the present invention, a flooring material formed by assembling a plurality of flooring panels with one another comprises a recessed part formed at one end of a flooring panel; a tongue part formed at one end of another flooring panel so as to be assembled in the recessed part; an accommodating recess formed in the recessed part; and a rotational body which is rotatably accommodated in the accommodating recess, secures the tongue part by being rotated in one direction when the tongue part is assembled in the recessed part, releases the tongue part from the secured state by being rotated in the opposite direction when the tongue part is separated from the recessed part.

Furthermore, preferably, the rotational body comprises a rotational body part rotatably accommodated in the accommodating recess; a catching rib provided along a longitudinal direction of the rotational body part and arranged to be caught in a catching recess formed at the tongue part as the rotational body part is driven to be rotated by the tongue part; and a driving protrusion provided on one side of the rotational body part and moved by the tongue part to drive the rotational body part for rotation thereof.

Furthermore, preferably, the driving protrusion is formed with a predetermined length only over a section of the rotational body part on one end portion side thereof, and when the tongue part is rotated downward with respect to a position in which one end of the tongue part and one end of the recessed part abut against each other and then is joined in the recessed part, the other end of the tongue part presses the driving protrusion, whereby the rotational body part is rotated and thus the catching rib is caught in the catching recess.

Furthermore, preferably, as the tongue part is joined in the recessed part, the rotational body part is rotated in one direction and thus the catching rib is caught in the catching recess and at the same time the driving protrusion is secured between a lower end portion of the tongue part and bottom upper surface of the recessed part.

Furthermore, preferably, as the tongue part is separated from the recessed part, the catching rib is driven by the catching recess, thus the rotational body part is rotated in the opposite direction.

Furthermore, preferably, the catching rib is formed along a longitudinal direction of the rotational body part with a predetermined length only over a section of the rotational body part, and when the tongue part is rotated downward with respect to a position in which one end of the tongue part and one end of the recessed part abut against each other and then is joined in the recessed part, the other end of the tongue part presses the driving protrusion, whereby the rotational body part is rotated to be caught in the catching recess.

Meanwhile, a flooring material according to another aspect comprises a first flooring panel which is provided with a recessed part formed by a protruded lower lip on a short side of the panel, wherein a accommodating recess is formed in the recessed part; a second flooring panel which is formed on its short side with a tongue part assembled in the recessed part, wherein a catching recess is formed at the tongue part; and a rotational body which is rotatably accommodated in the accommodating recess of the first flooring panel, is driven by the tongue part to be rotated in one direction and then caught in the catching recess when the second flooring panel is assembled to the first flooring panel, and, is rotated in the opposite direction and then released from being caught in the catching recess when the second flooring panel is separated from the first flooring panel.

Furthermore, preferably, the flooring material further comprises a third flooring panel defining a long side tongue part joined to a first long side recessed part formed on a long side of the first flooring panel and a second long-side recessed part formed on a long side of the second flooring panel, and by joining the third flooring panel to the first and second flooring panels, the rotational body is secured, thereby providing a support force of vertical direction for the second flooring panel.

Meanwhile, according to yet another aspect of the present invention, a rotational body used with flooring material formed by assembling a recessed part of a flooring panel and a tongue part of another flooring panel with each other comprises a rotational body part accommodated in an accommodating recess formed in the recessed part so that the body part can be rotated in one direction and opposite direction; a catching rib provided along a longitudinal direction of the rotational body part and arranged to be caught in a catching recess of the tongue part as the rotational body part is rotated by the tongue part; and a driving protrusion provided on one side of the rotational body part and moved by the tongue part to drive the rotational body part for rotation thereof.

Furthermore, preferably, the catching rib and driving protrusion are formed so as to have a phase difference of a predetermined angle with respect to a rotational center of the rotational body part.

Furthermore, preferably, the rotational body part, catching rib and driving protrusion are formed of material which is not substantially subject to deformation due to distortion.

Furthermore, preferably, the rotational center of the rotational body driven to be rotated by the driving protrusion is present inside the rotational body part.

Furthermore, preferably, the driving protrusion is formed with a predetermined length on one end side of the rotational body part, and the catching rib is formed with a predetermined length at predetermined distance from the driving protrusion of the rotational body part, substantially parallel to the driving protrusion, and the driving protrusion and the catching rib are formed so as not to overlap with each other in a vertical direction.

Furthermore, preferably, the driving protrusion is formed with a predetermined length on end portion side of the rotational body part, and the catching rib is also formed with a predetermined length on the other end portion side of the rotational body part, and the driving protrusion and the catching rib are formed so as to have a phase difference of a predetermined angle with respect to a rotational center of the rotational body part, and arbitrary vertical line perpendicular to an imaginary center line passing through the rotational center meets only one of the driving protrusion and the catching rib.

Advantageous Effects

The flooring material and rotational body used therewith according to the present invention have an effect that they improve reliability in quality of flooring materials by stably providing not only the fastening force of horizontal direction but also the fastening force of vertical direction when flooring panels are assembled with each other, thereby facilitating assembly of the flooring panels and strengthening the joining force due to assembly.

Furthermore, another effect is obtained that the flooring material and a rotational body used therewith according to the present invention facilitate separating of the flooring panels in the opposite direction when problems have arisen in the flooring panels after assembling thereof, thereby saving time, labor and cost required for execution of the flooring panels and increase the convenience of execution.

BEST MODES FOR CARRYING OUT THE INVENTION

An example of the flooring material and a rotational body used therewith according to the present invention will be described in more detail with reference to the drawings.

Figure 1:
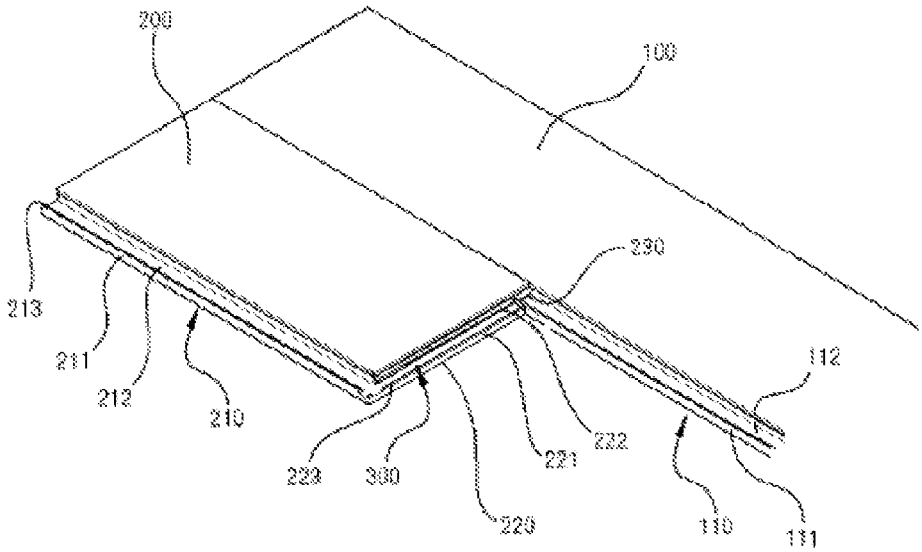
FIG. 1 is a view showing respective flooring panels of a flooring material according to an example of the present invention.

First, referring to FIG. 1, the flooring material according to an example of the present invention will be schematically described.

The flooring material according to the present invention preferably consists of material such as wood, plywood, MDF, HDF, PB, PVC and any mixture or compound thereof and the like.

Here, MDF stands for Medium Density Fiberboard, HDF stands for High
Density Fiberboard, PB stands for Particle Board, and PVC stands for PolyVinyl Chloride.

The flooring material according to the present invention is executed through assembling of a plurality of flooring panels with one another, wherein one panel has short side and long side and assembly structure for assembling the flooring panels is formed on each of the short side and long side.

A recessed part is formed on one long side of the flooring panel and a tongue part is formed on the other long side, so the long sides of respective flooring panels are assembled with each other by joining the tongue part on one long side of a flooring panel to the recessed part on one long side of another flooring panel, and a recessed part is formed on one short side of the flooring panel and a tongue part is formed on the other short side, so the short sides of respective flooring panels are assembled with each other by joining the tongue part on one short side of a flooring panel to the recessed part on one short side of another flooring panel.

Therefore, any one flooring panel is assembled with another flooring panel on their short sides and is assembled with yet another flooring panel on their long sides, whereby the entire flooring material is achieved.

Of course, it is not always the case that the assembly structure is necessarily formed on short side and long side of all the flooring panels. The assembly structure is formed only on the short side and any assembly structure may not be formed on the long side, and it is also possible that the assembly structure is not formed on the short side and the assembly structure is formed only on the long side.

The flooring material according to an example illustrated in FIG. 1 is in a state where a long side (110) of the first flooring panel (100) is joined to a long side of the second flooring panel (200), wherein a lower lip (111) is formed on the long side (110) of the first flooring panel (100) and a recessed part (112) is formed at the lower lip (111), and a tongue part (230) formed on the long side of the second flooring panel (200) is joined to the recessed part (112) on the long side (110) of the first flooring panel (100), whereby assembly is achieved.

The second flooring panel (200) is formed with a lower lip (211) on a long side (210) opposite the side joined to the first flooring panel (100) (the side where the tongue part (230) is formed) and a recessed part (212) and step protrusion (213) are formed at the lower lip (211).

Furthermore, a lower lip (221) is also formed on one short side (220) of the second flooring panel (200) and a recessed part (222) and step protrusion (223) are formed at the lower lip (221) and can be joined to a tongue part on one short side of another flooring panel.

The flooring material according to the present invention is characterized in that a rotational body (300) is arranged on one short side of a flooring panel as illustrated in FIG. 1 and the joining force of vertical direction can be provided by movement of the rotational body (300) when one flooring panel and another flooring panel are joined to each other on their short sides. Feature of the above-mentioned rotational body (300) will be described below.

Figure 2:
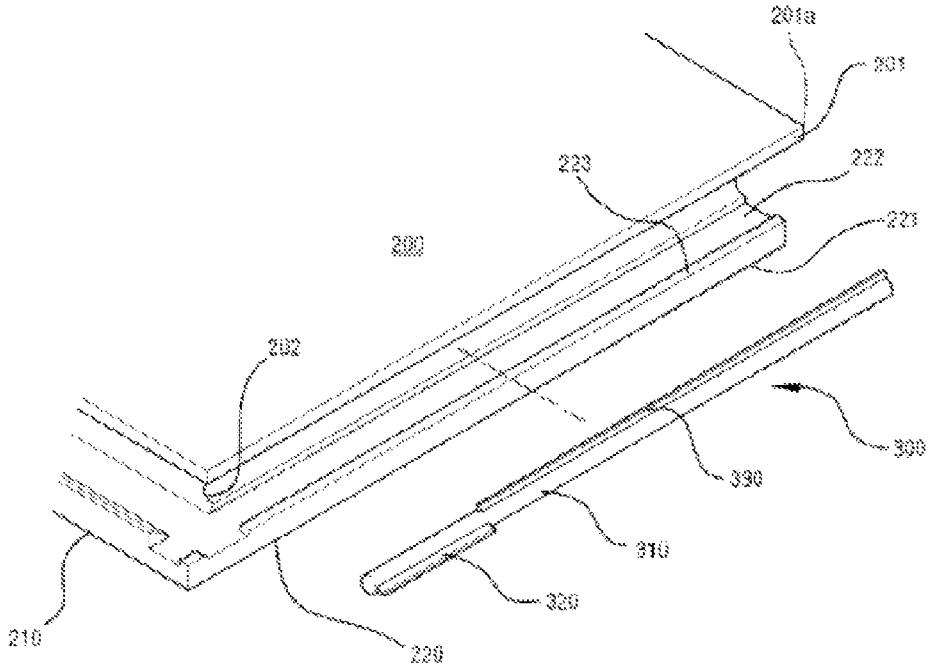
FIG. 2 is an enlarged view showing the flooring panels and rotational body illustrated in FIG. 1.
Figure 3:
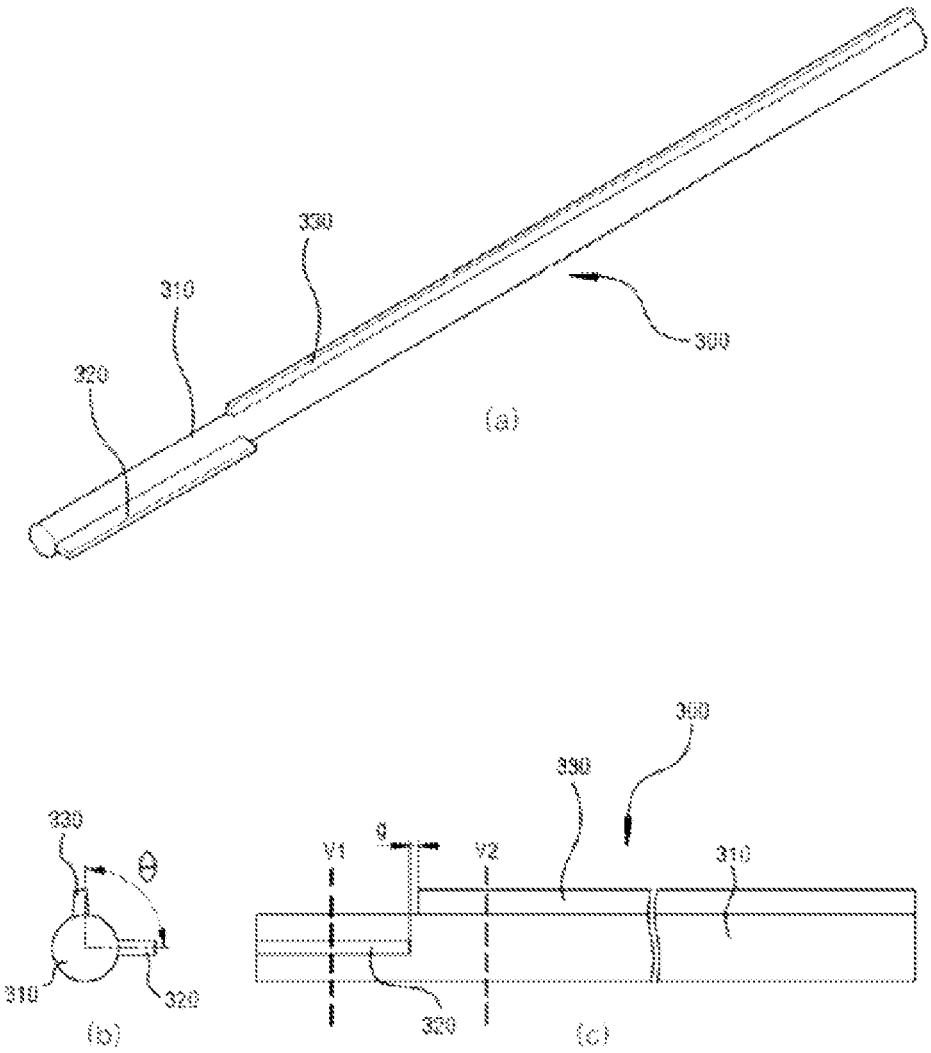
FIG. 3 is a view showing a rotational body used with the flooring panel illustrated in FIG. 2, wherein (a) of FIG. 3 shows a perspective view, (b) of FIG. 3 shows a front view, and (c) of FIG. 3 shows a side view.

Meanwhile, FIG. 2 shows one short side of the second flooring panel illustrated in FIG. 2 in further enlarged scale, and FIG. 3 shows the structure of rotational body illustrated in FIG. 2 in more detail.

As illustrated in FIG. 2, one short side (220) of the flooring panel (200) is formed with the lower lip (221) and the recessed part (222) is formed at the lower lip (221), to which part the tongue part of another flooring panel can be joined, and the step protrusion (223) is formed at the recessed part (222) in order to provide the joining force of horizontal direction when the tongue part of another flooring panel is joined to the recessed part (222).

On upper surface of upper plate part (201) of the flooring panel (200), a decorative layer may be formed from appearance paper, pattern wood, printing and the like in order to express particular pattern or appearance, and a protective layer made of resin and the like also may be formed on the decorative layer.

Furthermore, in the flooring panel (200), edges (201*a*) of four side surfaces of the upper plate part (201) may be preferably beveled, and material (paraffin, resin, oil etc.) for preventing ingress of water may be also applied on or impregnated into the side surfaces of the flooring panel, thereby adding a function of protecting the flooring panel from water and moisture.

Furthermore, formed on lower surface of the flooring panel (200) may be a protective layer impregnated with resin or a layer corresponding to the layer formed on the upper surface.

Meanwhile, as illustrated in FIG. 2, an accommodating recess (202) for accommodating the rotational body (300) is formed between the upper plate part (201) and lower lip (221).

The rotational body (300) is arranged so that it can be rotated over a predetermined angle while accommodated in the accommodating recess (202).

The rotational body (300) has a rotational body part (310) accommodated in the accommodating recess (202) so that it can be rotated in one direction and opposite direction, a driving protrusion (320) provided on one side of the rotational body part (310) and a catching rib (330) formed along a longitudinal direction of the rotational body part (310).

More details of the structure of rotational body (300) will be described with reference to FIG. 3.

(a) of FIG. 3 shows a perspective view of the rotational body illustrated in FIG. 2, (b) of FIG. 3 shows a front view of the rotational body and (c) of FIG. 3 shows a side view of the rotational body.

The rotational body (300) illustrated in FIGS. 2 and 3 is a member for providing the joining force of vertical direction for two joined flooring panels when the two flooring panels are joined to each other on their short sides (when the tongue part on one short side of one flooring panel is joined to the recessed part on one short side of another flooring panel).

That is to say, with the rotational body (300) being accommodated in the accommodating recess of the flooring panel formed with the recessed part, if another flooring panel is joined to the flooring panel, the another flooring panel pushes the driving protrusion (320) to thereby rotate the rotational body part (310) and then the catching rib (330) is caught by end portion of the another flooring panel, thus providing the joining force of vertical direction.

In this connection, the movement and operation of the rotational body associated with joining of two flooring panels will be described below, and to begin with, the structure of rotational body is described.

It is preferred that the rotational body part (310) of the rotational body (300) has a solid cylindrical shape so as to be smoothly rotated while enduring load. Furthermore, the rotational body part (310) may be made of metal or plastic material which is not subject to deformation resulting from distortion due to the load.

As illustrated in (a) to (c) of FIG. 3, it is preferred that the driving protrusion (320) is formed with a predetermined length only over a section of the rotational body part (310) on one side thereof and the catching rib (330) is also formed with a predetermined length only over a section of the rotational body part (310) on the other side thereof, and it is preferred the driving protrusion (320) and the catching rib (330) are formed so as to have a phase difference of a predetermined angle with respect to a center of the rotational body part (310).

More specifically, it is preferred that the driving protrusion (320) and the catching rib (330) are formed at their respective positions of angular difference of $\theta°$ with respect to the center (C) of the rotational body part (310) as illustrated in (b) of FIG. 3. Here, $\theta$ may be approximately 90° and a little greater or less than 90°.

Also, as illustrated in (c) of FIG. 3, it is preferred that the driving protrusion (320) and the catching rib (330) are formed so as not to overlap with each other in a vertical direction.

That is to say, as illustrated in FIG. 3, it is preferred that if arbitrary vertical lines (V1, V2) are drawn which are perpendicular to an imaginary center line (CL) passing through the center of rotational body part (310), each of vertical lines (V1, V2) meets only one of the driving protrusion (320) and the catching rib (330).

Here, a gap may be present between inner end of the driving protrusion (320) and inner end of the catching rib (330), as illustrated in FIG. 3(*c*). Here, "g" may be zero or have a value greater than zero, where the "g" is the dimension of the gap.

Meanwhile, with reference to FIGS. 4 to 7, a process of joining two flooring panels on their short sides by using the rotational body having the structural features as described above, associated movement of the rotational body and operational effect thereof will be described.

Figure 4:
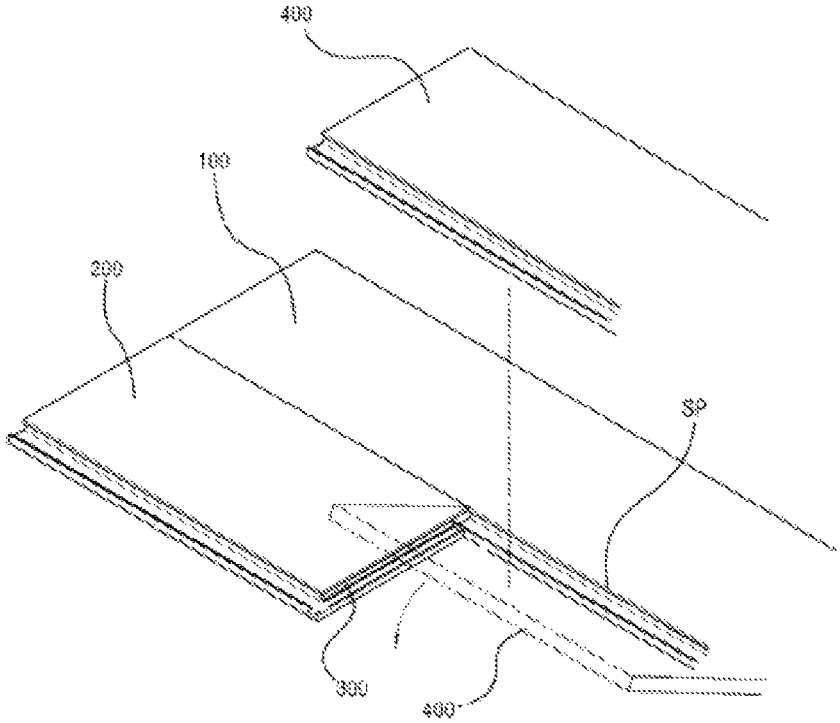
FIG. 4 is a view showing a process of joining yet another flooring panel in a state illustrated in FIG. 1.

As illustrated in FIG. 4, with the second flooring panel (200) being joined to the first flooring panel (100) on their long sides, the third flooring panel (400) is joined. At this time, the third flooring panel (400) and the first flooring panel (100) are joined on their long sides and the third flooring panel (400) and the second flooring panel (200) are joined on their short sides.

Also, the rotational body (300) moves between the short side of the second flooring panel (200) and the short side of the third flooring panel (400).

Figure 5:
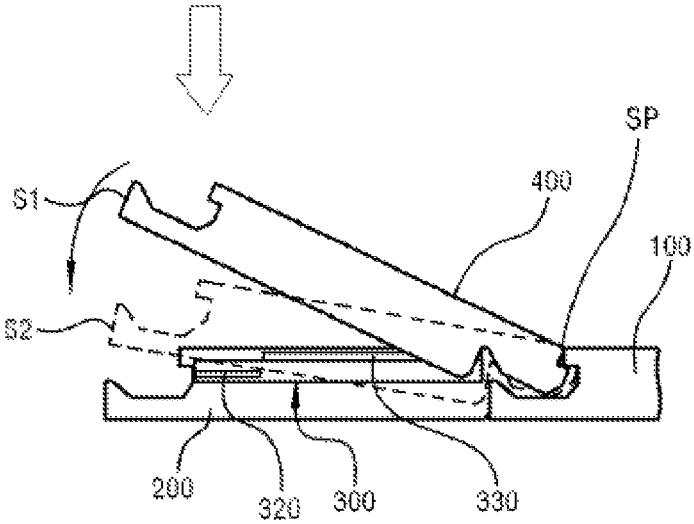
FIG. 5 is a view showing a side of joining process of FIG. 4.

At this time, as illustrated in FIGS. 4 and 5, the third flooring panel (400) is rotated downward with respect to a reference point (SP) of already joined part in folding-down manner, whereby assembly is achieved. Of course, all of the flooring panels constituting the flooring material according to the present invention may be joined in such a folding-down manner as described above.

The third flooring panel (400) is rotated in folding-down manner to be joined, i.e., is rotated from state (S1) to state (S2) with respect to the reference point (SP) to be joined, as illustrated in FIG. 5.

At this time, the rotational body (300) does not move, remaining stationary while accommodated in the accommodating recess of the second flooring panel (200) during the rotation of the third flooring panel (400) from the state (S1) to state (S2) as illustrated in FIG. 5.

Here, the state (S1) of the third flooring panel (400) is a state where the tongue part on the long side of the third flooring panel (400) begins to be fitted in the recessed part on the long side of the first flooring panel (100) for assembly, and the state (S2) of the third flooring panel (400) is a state immediately before a lower surface of the third flooring panel (400) contacts with the driving protrusion (320) of the rotational body (300) while the third flooring panel (400) in the state (S1) is rotated in a direction of arrow indicated in the figure, i.e., is folded down.

During the rotation of the third flooring panel (400) from the state (S1) to state (S2), the third flooring panel (400) and the rotational body (300) do not interfere with each other, therefore, the third flooring panel (400) can be smoothly assembled.

The reason is that since the driving protrusion (320) of the rotational body (300) is formed only over a section of the rotational body part (310) on one side thereof, the rotational body (300) does not move during a period in which the third flooring panel (400) does not meet the driving protrusion (320) while rotated from the state (S1) to state (S2).

Figure 6:
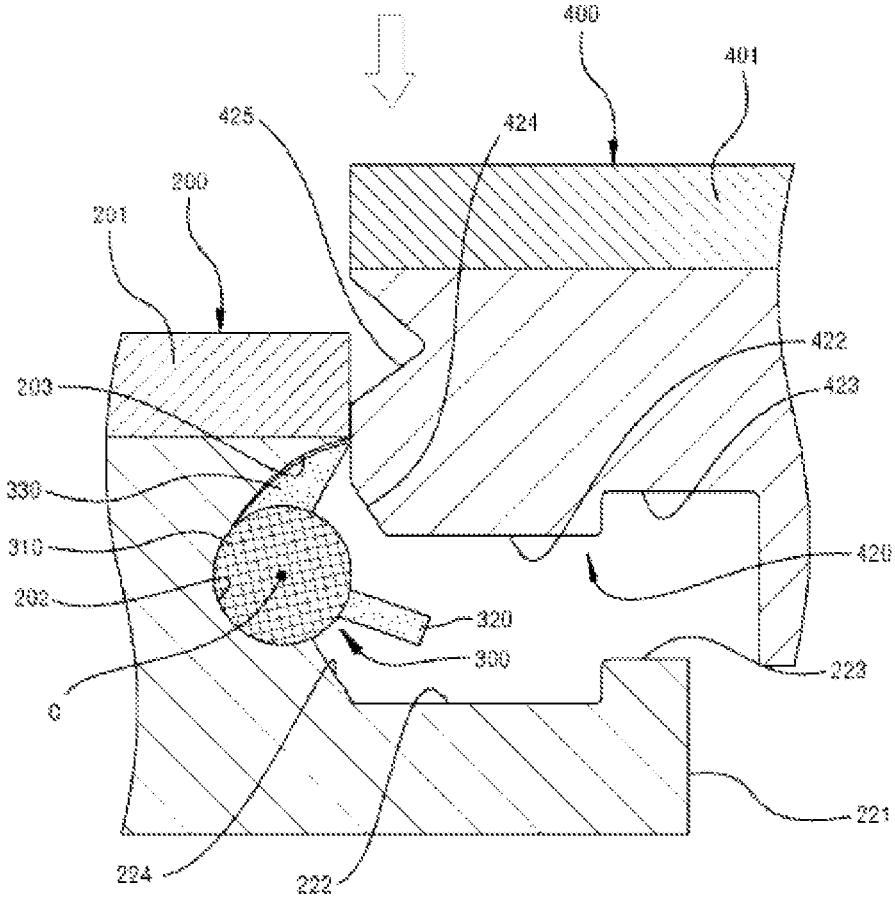
FIGS. 6 and 7 are views showing a section of a process of joining yet another flooring panel illustrated in FIG. 5.

FIG. 6 shows a side sectional view where assembled state of the third flooring panel (400) is the state (S2).

Prior to describing the movement of the rotational body (300), the structure of short side of the flooring panel is first described. As illustrated in FIG. 6, a tongue part (420) of the third flooring panel (400) is joined to the recessed part (222) formed at the lower lip (221) of the second flooring panel (200).

On the recessed part (222) side, the accommodating recess (202) is formed between the upper plate part (201) and lower lip (221), and the rotational body (300) is accommodated in the accommodating recess (202).

A wall part (203) is formed over the accommodating recess (202), and a seat part (224) is formed under the accommodating recess (202), and it is preferred that the seat part (224) is connected to the recessed part (222). It is preferred that the step protrusion (223) is formed at an end of the recessed part (222).

The tongue part (420) is formed below a upper plate panel (401) of the third flooring panel (400), and a lower tongue end part (422) is formed which is seated in the recessed part (222), and a step protrusion-accommodating part (423) accommodating the step protrusion (423) to join with it is formed on inward side of the lower tongue end part (422) and an operational part (424) corresponding to the seat part (224) is formed on outward side of the lower tongue end part (422).

Also, a catching recess (425) is formed between the operational part (424) and the upper plate part (401), which catching recess (425) is a part in which the catching rib (330) of the rotational body (300) is accommodated when joining of the tongue part and recessed part of the flooring panels has been completed.

Thus, if the third flooring panel (400) is further rotated downward from the state as illustrated in FIG. 6, the lower tongue end part (422) or operational part (424) of the tongue part (420) meets the driving protrusion (320) of the rotational body (300) and then press the driving protrusion (320).

If the driving protrusion (320) is pressed and then driven by the lower tongue end part (422) or operational part (424) of the tongue part (420), the rotational body part (310) is rotated in a direction of arrow indicated in the figure while accommodated in the accommodating recess (202).

Figure 7:
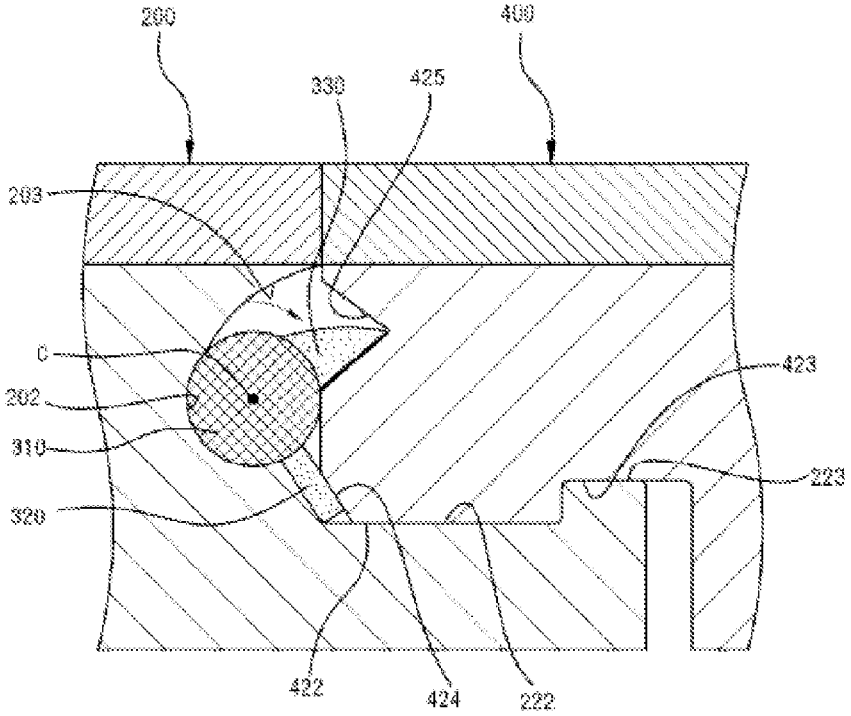

The catching rib (330) is accommodated in the catching recess (425) of the tongue part (420) while the rotational body part (310) is rotated, whereby catching structure is achieved as illustrated in FIG. 7.

To sum up, as illustrated in FIGS. 5 to 7, in joining the third flooring panel (400) to the second flooring panel (200) in folding-down manner, the third flooring panel (400) is rotated as illustrated in FIG. 5, and at this time, since the rotational body (300) does not interfere with the rotation of the third flooring panel (400) from the state (S1) to state (S2), i.e., until a lower end of the third flooring panel (400) meets the driving protrusion (320), the assembly can be very smoothly and easily achieved.

Also, as the lower tongue end part (422) or operational part (424) of the third flooring panel (400) presses the driving protrusion (320), the rotational body part (310) is rotated about rotational center (C) of the rotational body (300), and consequently the catching rib (330) is caught in the catching recess (425) of the tongue part, whereby the assembly is completed.

At this time, it is preferred that the rotational center (C) of the rotational body (300) is present inside the rotational body part (310), and more preferably, the rotational center (C) of the rotational body (300) substantially coincides with the center of the rotational body part (310) as illustrated FIGS. 6 and 7.

That is to say, when the rotational body (300) is driven to be rotated by the driving protrusion (320), the rotational body is rotated about the rotational center (C) at its place without deviating from the accommodating recess (202), whereby the catching rib (330) is caught in the catching recess (425).

By the way, the fastening force of vertical direction is not completely produced only by assembling the second flooring panel (200) and the third flooring panel (400) by the medium of the rotational body (300).

That is to say, the tongue part of the third flooring panel (400) is joined to the recessed part of the second flooring panel (200), and accordingly the catching rib (330) of the rotational body (300) is not secured while being caught in the catching recess (425) of the tongue part, and if the third flooring panel (400) is lifted upward (if it is lifted upward by rotating it in a direction opposite the folding-down direction), the rotational body (300) is oppositely rotated, whereby the catching rib (330) is deviated from the catching recess (425), and thus the third flooring panel (400) can be easily separated.

Figure 8:
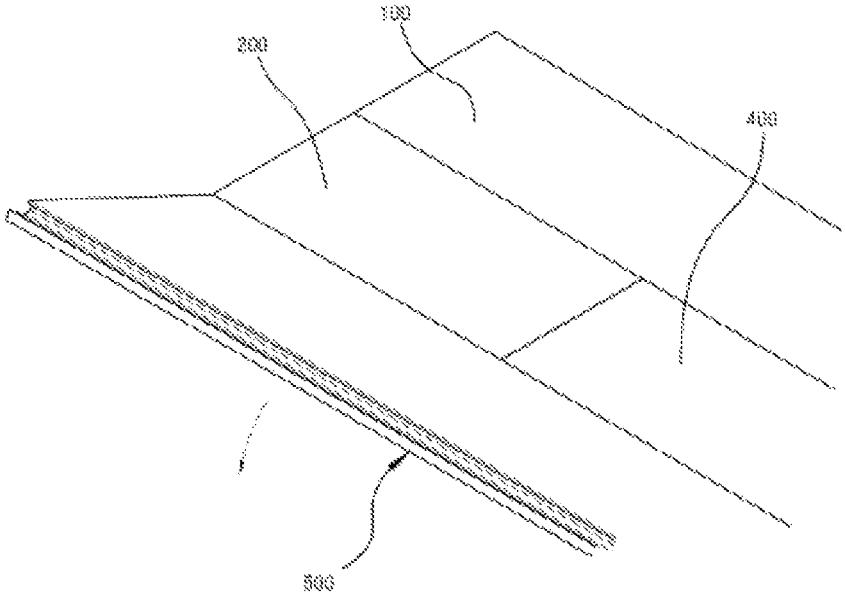
FIG. 8 is a view showing a process of joining yet another flooring panel in a state where the flooring panels are joined according to the process of FIGS. 4 and 5.

Therefore, in order to decidedly produce the joining force by the rotational body (300) after joining the third flooring panel (400) to the second flooring panel (200), yet another flooring panel, i.e., a fourth flooring panel (500) illustrated in FIG. 8 is joined to the long side of the second flooring panel (200) and the long side of the third flooring panel (400) at the same time, thus at last the joining force due to the rotational body (300) is decidedly produced.

That is to say, the long side of the second flooring panel (200) is joined to the first flooring panel (100) and the third flooring panel (400) is joined to the short side of the second flooring panel (200), and at this time the rotational body (300) is present between the short side of the second flooring panel (200) and the short side of the third flooring panel (400). Also, by joining the long side of fourth flooring panel (500) to the long side of the second flooring panel (200) and the long side of the third flooring panel (400), the joining force due to the rotational body (300) is produced, thus vertical deviation of the second flooring panel (200) or the third flooring panel (400) can be securely prevented and a problem can be completely solved that central portions of the short sides of the second flooring panel (200) and the third flooring panel (400) abutting against each other are separated and displaced from each other.

Meanwhile, in the event that a certain flooring panel has a problem and so the flooring panel has to be removed while a plurality of flooring panels are assembled with one another in the manner as described above, the flooring material according to the present invention provides construction enabling the problematic flooring panel to be very easily removed by means of the rotational body. In this regard, relevant description will be given with reference to FIGS. 9 to 11.

Figure 9:
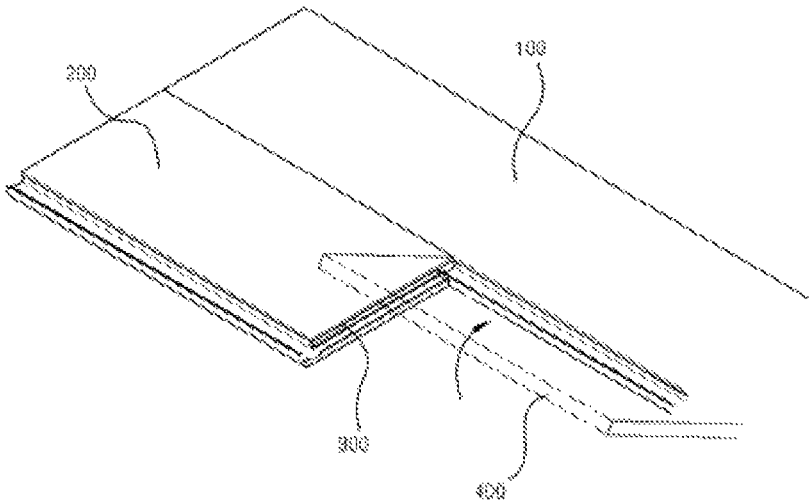
FIGS. 9 to 11 are view showing a process of separating the assembled flooring panels.

In order to remove the problematic flooring panel, the assembled flooring panels have to be separated. As illustrated in FIG. 9, if the fourth flooring panel is first removed, the third flooring panel (400) can be easily separated by rotating the third flooring panel in a direction of arrow indicated in the figure.

That is to say, it is possible to easily separate the fourth flooring panel (not illustrated) joined to the long side of the second flooring panel (200) and the long side of the third flooring panel (400), and if like this the fourth flooring panel is separated, the rotational body (300) loses its decided joining force, thereby being in provisionally secured state, and thus the third flooring panel (400) can be easily separated.

Figure 10:
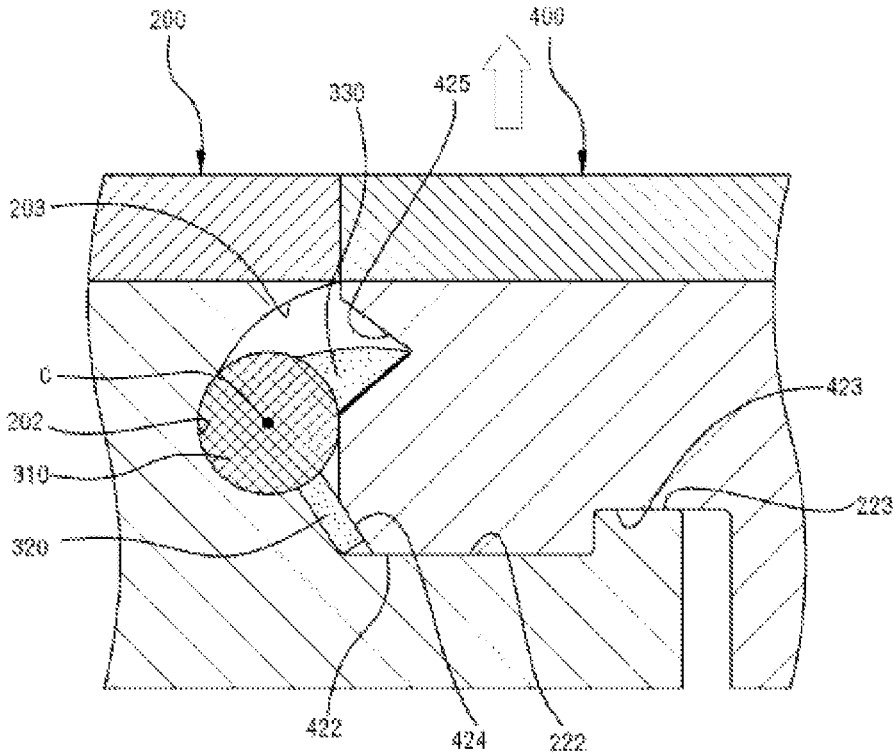
Figure 11:
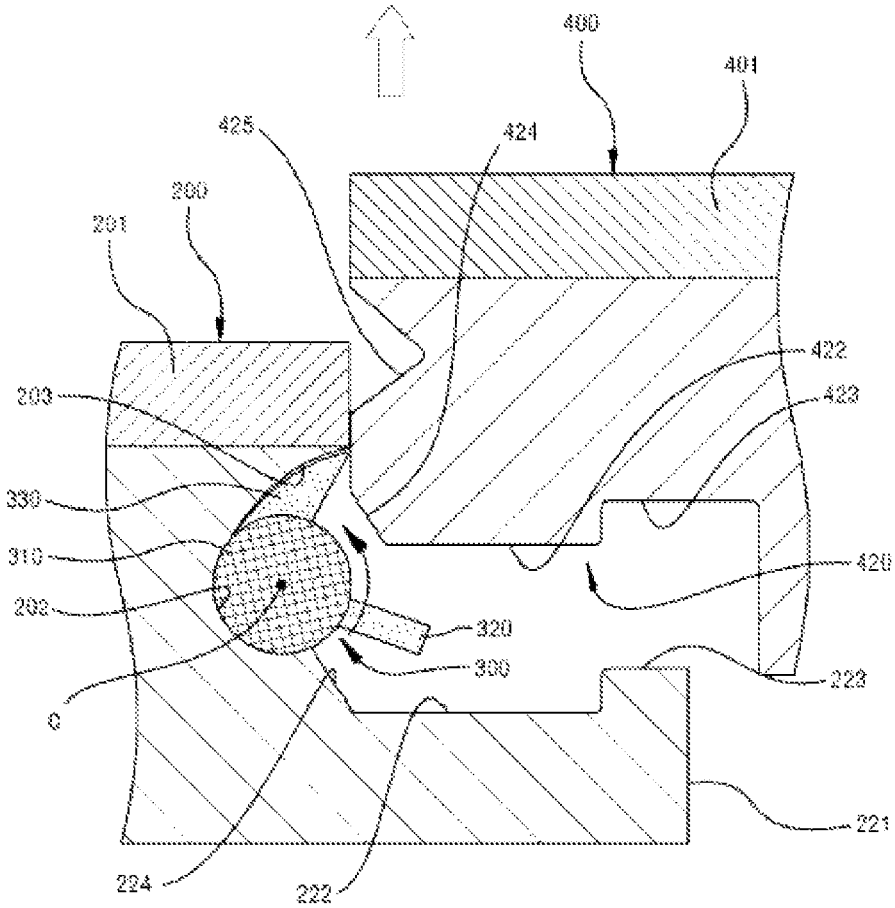

FIGS. 10 and 11 show a process of separating the third flooring panel (400). As illustrated in FIG. 10, from the state where the third flooring panel (400) is joined to the second flooring panel (200), if the third flooring panel (400) is lifted while being rotated upward, the rotational body part (310) is oppositely rotated about the rotational center (C) while the catching rib (330) of the rotational body (300) caught in the catching recess (425) of the third flooring panel (400) is pressed, and thus the third flooring panel (400) can be easily separated as illustrated in FIG. 11.

Therefore, since the flooring material according to the present invention can easily separate the problematic panel owing to the structural feature of the rotational body, the present invention can completely solve a conventional problem that a separating operation is very fastidious and complicated for removing the problematic flooring panel after assembling of the flooring panels.

Various examples relating to the flooring material and a rotational body used therewith according to the present invention are described in detail in the section "BEST MODES FOR CARRYING OUT THE INVENTION".

The flooring material and rotational body used therewith according to the present invention have an industrial applicability in that they stably provide not only the fastening force of horizontal direction but also the fastening force of vertical direction when flooring panels are assembled with each other, thereby facilitating assembly of the flooring panels and strengthening the joining force due to assembly, and facilitate separating of the flooring panels in the opposite direction when problems have arisen in the flooring panels after assembling thereof, thereby saving time, labor and cost required for execution of the flooring panels.

What is claimed:

1. A flooring material formed by assembling a plurality of flooring panels with one another, comprising:

a recessed part formed at one end of a flooring panel;

a tongue part formed at one end of another flooring panel so as to be assembled in the recessed part;

an accommodating recess formed in the recessed part; and a rotational body which is rotatably accommodated in the accommodating recess, wherein the rotational body comprises an elongate structure divided into first and second halves with respect to a longitudinal central position thereof, wherein the first and second halves are asymmetrical to each other in a shape, wherein the rotational body secures the tongue part by being rotated in one direction when the tongue part is assembled in the recessed part, and releases the tongue part from the secured state by being rotated in the opposite direction when the tongue part is separated from the recessed part.

2. The flooring material according to claim 1, wherein the elongate structure comprises:

a rotational body part rotatably accommodated in the accommodating recess;

a catching rib provided along a longitudinal direction of the rotational body part and arranged to be caught in a catching recess formed at the tongue part as the rotational body part is driven to be rotated by the tongue part; and a driving protrusion provided on one side of the rotational body part and moved by the tongue part to drive the rotational body part for rotation thereof.

3. The flooring material according to claim 2, wherein the driving protrusion is formed with a predetermined length only over a section of the rotational body part on one end portion side thereof, and when the tongue part is rotated downward with respect to a position in which one end of the tongue part and one end of the recessed part abut against each other and then is joined in the recessed part, the other end of the tongue part presses the driving protrusion, whereby the rotational body part is rotated and thus the catching rib is caught in the catching recess.

4. The flooring material according to claim 2, wherein as the tongue part is joined in the recessed part, the rotational body part is rotated in one direction and thus the catching rib is caught in the catching recess and at the same time the driving protrusion is secured between a lower end portion of the tongue part and bottom upper surface of the recessed part.

5. The flooring material according to claim 2, wherein as the tongue part is separated from the recessed part, the catching rib is driven by the catching recess, thus the rotational body part is rotated in the opposite direction.

6. The flooring material according to claim 2, wherein the catching rib is formed along a longitudinal direction of the rotational body part with a predetermined length only over a section of the rotational body part, and when the tongue part is rotated downward with respect to a position in which one end of the tongue part and one end of the recessed part abut against each other and then is joined in the recessed part, the other end of the tongue part presses the driving protrusion, whereby the rotational body part is rotated to be caught in the catching recess.

7. A flooring material, comprising:

a first flooring panel which is provided with a recessed part formed by a protruded lower lip on a short side of the panel, wherein a accommodating recess is formed in the recessed part;

a second flooring panel which is formed on its short side with a tongue part assembled in the recessed part, wherein a catching recess is formed at the tongue part; and a rotational body which is rotatably accommodated in the accommodating recess of the first flooring panel, is driven by the tongue part to be rotated in one direction and then caught in the catching recess when the second flooring panel is assembled to the first flooring panel, and, is rotated in the opposite direction and then released from being caught in the catching recess when the second flooring panel is separated from the first flooring panel, wherein the rotational body comprises an elongate structure divided into first and second halves with respect to a longitudinal central position thereof, wherein the first and second halves are asymmetrical to each other in a shape.

8. The flooring material according to claim 7, comprising a third flooring panel.

9. A rotational body used to assemble a recessed part of a flooring panel and a tongue part of another flooring panel with each other, wherein the rotational body comprises an elongate structure divided into first and second halves with respect to a longitudinal central position thereof, wherein the first and second halves are asymmetrical to each other in a shape, wherein the elongate structure comprises:

a rotational body part accommodated in an accommodating recess formed in the recessed part so that the body part can be rotated in one direction and opposite direction;

a catching rib provided along a longitudinal direction of the rotational body part and arranged to be caught in a catching recess of the tongue part as the rotational body part is rotated by the tongue part; and a driving protrusion provided on one side of the rotational body part and moved by the tongue part to drive the rotational body part for rotation thereof.

10. The rotational body according to claim 9, wherein the catching rib and driving protrusion are formed so as to have a phase difference of a predetermined angle with respect to a rotational center of the rotational body part.

11. The rotational body according to claim 9, wherein the rotational body part, catching rib and driving protrusion are formed of material which is not substantially subject to deformation due to distortion.

12. The rotational body according to claim 9, wherein the rotational center of the rotational body driven to be rotated by the driving protrusion is present inside the rotational body part.

13. The rotational body according to claim 9, wherein the driving protrusion is formed with a predetermined length on one end side of the rotational body part, and the catching rib is formed with a predetermined length at predetermined distance from the driving protrusion of the rotational body part, substantially parallel to the driving protrusion, and the driving protrusion and the catching rib are formed so as not to overlap with each other in a vertical direction.

14. The rotational body according to claim 9, wherein the driving protrusion is formed with a predetermined length on end portion side of the rotational body part, and the catching rib is also formed with a predetermined length on the other end portion side of the rotational body part, and the driving protrusion and the catching rib are formed so as to have a phase difference of a predetermined angle with respect to a rotational center of the rotational body part, and arbitrary vertical line perpendicular to an imaginary center line passing through the rotational center meets only one of the driving protrusion and the catching rib.

15. The flooring material according to claim 2, wherein the driving protrusion is formed along a longitudinal direction of the rotational body part with a predetermined length only over a section of the rotational body part on one end portion side thereof, and on the other end portion side opposite the one end portion in which the driving protrusion is formed, the catching rib is formed with a predetermined length only over a section of the rotational body part while having a different phase difference, and arbitrary vertical line perpendicular to an imaginary center line passing through the center of the rotational body meets only one of the driving protrusion and the catching rib, and the rotational center of the rotational body driven to be rotated by the driving protrusion is present on the center of the rotational body part or near the center, and as the tongue part of the second flooring panel is joined in the recessed part of the first flooring panel, the rotational body is rotated in one direction and thus the catching rib is caught in the catching recess of the second flooring panel, and from a state where the catching rib is caught in the catching recess, as the tongue part of the second flooring panel is separated from the recessed part of the first flooring panel, the rotational body is oppositely rotated and thus the catching rib can be deviated from the catching recess, thereby enabling free separation of the recessed part and tongue part from each other.

* * * * *